United States Patent [19]

Weyant

[11] 3,981,438

[45] Sept. 21, 1976

[54] CENTRIFUGE ROTOR HAVING SWINGING MEMBERS WITH VARIABLE PIVOT POINTS

[75] Inventor: Oakley Louis Weyant, Sandy Hook, Conn.

[73] Assignee: E. I. Du Pont de Nemours and Company, Wilmington, Del.

[22] Filed: June 19, 1975

[21] Appl. No.: 588,646

[52] U.S. Cl. ..... 233/26

[51] Int. Cl.[2] ..... B04B 5/00

[58] Field of Search ..... 233/1 R, 14 R, 14 A, 233/16, 25, 26, 27

[56] References Cited

UNITED STATES PATENTS

| | | | |
|---|---|---|---|
| 486,390 | 11/1892 | Berg | 233/26 |
| 3,877,634 | 4/1975 | Rohde et al. | 233/14 R |

FOREIGN PATENTS OR APPLICATIONS

| | | | |
|---|---|---|---|
| 1,458 | 3/1887 | Denmark | 233/26 |
| 535,188 | 4/1941 | United Kingdom | 233/26 |

*Primary Examiner*—George H. Krizmanich

[57] ABSTRACT

A centrifuge rotor has a plurality of swinging buckets or bucket carriers disposed on its periphery. Mounting pins, having an oblong cross-section, for the buckets are secured to the rotor itself. These pins are pivotally engaged with enlarged holes in the buckets such that the oblong pivots encounter a shifting pivot point as the buckets swing outwardly during spinning. This facilitates the bucket's hanging with an inward slant when at rest and yet assuming a true horizontal position when it spins.

7 Claims, 4 Drawing Figures

CENTRIFUGE ROTOR HAVING SWINGING MEMBERS WITH VARIABLE PIVOT POINTS

BACKGROUND OF THE INVENTION

This invention relates to centrifuge rotors and, more particularly, to a centrifuge rotor having swinging members whose pivot point shifts during operation to facilitate operation.

One of the many application of centrifuges is that of processing biological substances. According to usual practice, these biological substances are placed in a swinging bucket or swinging carriers holding test tubes. The substances are then subjected to centrifugal force by the centrifuge. During this operation the swinging buckets swing outwardly and the heavier components of the substance are driven to the bottom of the test tubes. Following this the rotor is stopped, allowing the tubes to swing back down to the vertical position. They are locked in this position and the centrifuge again operated such that the top portion of the contents of the bucket become decanted. Additional washing or other liquids are supplied to the tubes typically during the time that they are in the horizontal spinning position.

A cell washing centrifuge apparatus for processing substances in this manner is described, for example, in U.S. Pat. No. 3,420,437 issued Jan. 7, 1969 to Josef Blum. As is described in the said Blum patent, because of the manner in which the tubes are hinged to the rotor — off center of the longitudinal axis of the tubes — they hang normally at a slight negative angle relative to the vertical axis of the rotor, such that they are easily locked in position to effect positive as well as negative angle decanting.

Unfortunately one of the problems encountered with a system of this type, is caused by the fact that the hinge or pivot point of the tube is off center from the longitudinal axis of the tube. Hence, the tubes are not quite able to assume a true horizontal position during spinning. With the tubes in a generally horizontal position, their hinge point is below their center of gravity and the resulting lever arm between the hinge point and the center of gravity or the axis of the tube forces the tubes downwardly somewhat. Because the tubes are unable to assume a true horizontal position, the resulting separation is not quite as perfect as would otherwise be desired.

It is therefore an object of this invention to obviate many of the disadvantages of the prior art swinging member centrifuges.

An additional object of this invention is to provide an improved centrifuge rotor whose swinging members have a shifting pivot point which shifts to improve operation.

A further object of this invention is to provide an improved centrifuge rotor whose swinging members are able to swing to a true horizontal position during operation.

SUMMARY OF THE INVENTION

According to the present invention, a centrifuge for processing biological substances has a swinging bucket type rotor adapted to swing about a vertical axis with the buckets disposed pivotally about the periphery of the rotor. The buckets are adapted in use to pivot outwardly and upwardly, each said bucket having a longitudinal axis through its center of gravity. The combination includes a pivot means having a pair of spaced pivot points secured to said rotor for pivotally supporting each said bucket, and a hanger on each said bucket defining a pair of acutely intersecting cam surfaces adapted to contact said pivot means, thereby to shift the pivot point of said bucket as it swings outwardly.

In a particularly preferred embodiment of the invention, one of the cam surfaces is substantially parallel to the longitudinal axis of the bucket, and is spaced therefrom by a first distance, the spacing between said pivot points exceeding said first distance. By this arrangement, the swinging members, pivot points shift radially of the rotor from one side of the longitudinal axis of the bucket to the other depending on whether the bucket is in a vertical or rest position or a horizontal or spinning position. This facilitates both positive or negative angle decanting and a horizontal orientation during spinning.

BRIEF DESCRIPTION OF THE DRAWINGS

The novel features of this invention, as well as the invention itself, both as to its organization and method of operation, will best be understood from the following description when read in connection with the accompanying drawing, in which like reference numerals refer to like parts, and in which.

DESCRIPTION OF THE PREFERRED EMBODIMENTS

Figure 1:
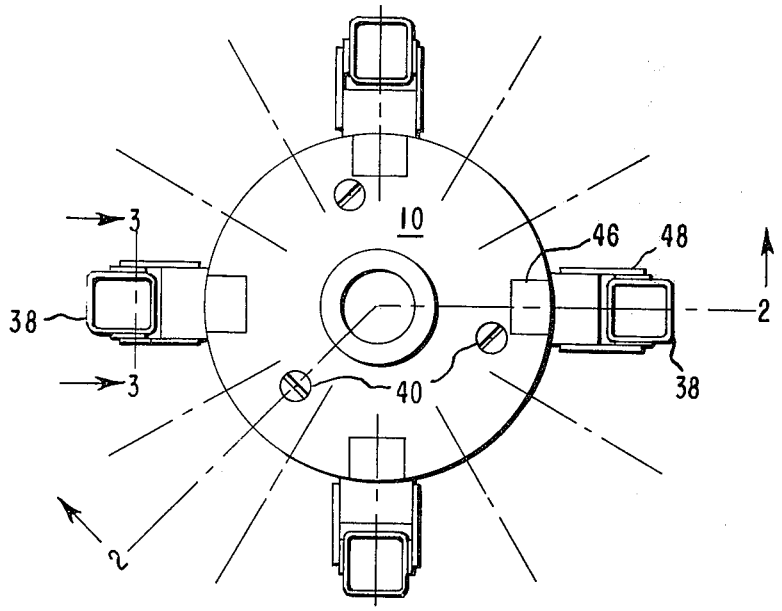
FIG. 1 is a plan view of a centrifuge rotor having swinging buckets constructed in accordance with a preferred embodiment of this invention.
Figure 2:
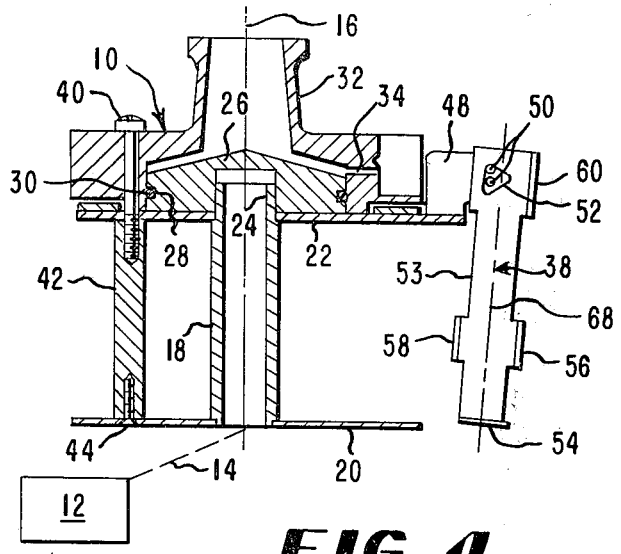
FIG. 2 is a cross-sectional elevation view taken along the section lines 2—2 of FIG. 1, particularly depicting the manner in which the buckets hang in their vertical orientation with a negative angle.
Figure 3:
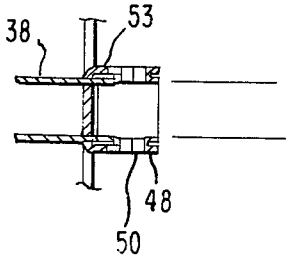
FIG. 3 is a fragmentary elevation view taken along the section line 3—3 of FIG. 1.

Referring particularly to FIGS. 1–3, inclusive, there is shown a typical cell-washing centrifuge of the type having a rotor 10 which is capable of dispensing washing fluids into swinging members which are capable of holding test tubes containing biological substances. The swinging members are adapted to swing out to a horizontal orientation during operation as desired or can be locked in position with a vertical orientation to provide decanting of the fluids contained in the test tubes. Rotor 10 is mounted in a conventional manner and driven by a drive system particularly depicted by the block 12. Although not specifically shown since it is not necessary to a proper understanding of this invention, the rotor 10 may be assumed to include a convention locking system, such as that depicted in said Blum patent, for holding the tubes in a vertical orientation during the decanting operation. The drive system 12 operates through suitable mechanical linkages depicted by the dashed line 14.

The rotor itself is adapted to spin about a vertical axis 16 and is composed of a central shaft 18 to which the mechanical drive linkage 14 is connected. At the bottom end of the shaft 18 there is secured a bottom plate 20 and in like manner at the top end of the shaft 18 there is secured as by a press fit a top plate 22. This leaves a protruding nib 24 of the shaft 18 which extends above the top plate. A distributor base 26 is piloted on to the nib 24 and contains a circumferential groove 28 in which is disposed an O-ring 30 which provides a seal between the distributor base 26 and the distributor cap 32. The distributor cap 32 fits about the distributor base 26 and is piloted thereby and for this purpose has a vertically extending skirt-like portion which engages the O-ring 30.

The distributor cap 32 is essentially a hollow chamber which is adapted to feed fluids through radially disposed feed tubes 34 in the cap 32 to the peripherally disposed buckets or bucket carriers 38. The distributor cap 32 is secured to the top plate 22 as by screws 40 which engage supports 42. Each of the supports 42, which provide a three points support, extend between the top plate 22 and the bottom plate 20. They are secured to the bottom plate 20 by screws 44. Since the mechanism for dispensing fluids into the distributor cap 32 does not form part of this invention, such will not be disclosed further. Suffice it to say that such fluids may be fed directly into the distributor cap along the vertical axis 16 by any appropriate means such as that illustrated, for example, in the U.S. Pat. No. 2,834,541 issued May 13, 1958 to A. St. George et al.

Figure 4:
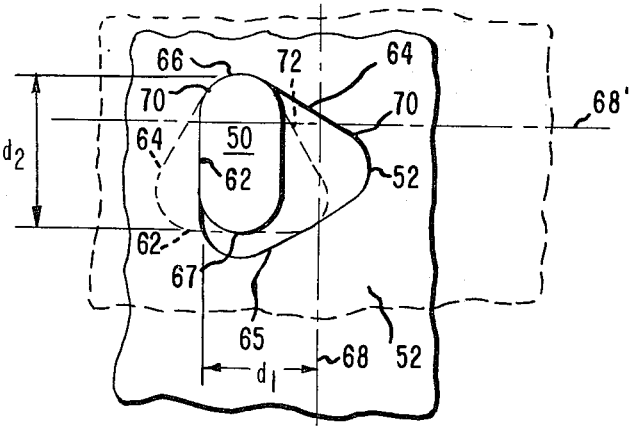
FIG. 4 is a fragmentary side elevation view partly in phantom showing the manner in which the pivot point of the swinging member shifts during operation.

To facilitate the hanging of the several buckets or test tube carriers 38, a plurality of brackets 46 are secured as by soldering, brazing, or other appropriate means to the top plate 22. Each bracket 46 extends outwardly and is U-shaped when viewed in the elevation view with a pair of forked tabs 48 extending upwardly and outwardly. These forked tabs 48 each has secured thereto horizontally disposed pivots 50 extending inwardly therefrom to provide a pivot stub having a generally oval or elongated cross section. The pivot stubs are adapted to engage corresponding openings 52 formed in the sides of the test tube carriers 38. Each test tube carrier or bucket 38 is an elongated member having vertically extending sidewalls 53 which are secured at the bottom by a bottom support 54 and at the lower midsection by a lower front support 56 and a lower back support 58 and at the top by a top support ring 60. The openings 52, which provide the necessary surfaces or cam edges for hanging the swinging test tube carriers, as may perhaps be seen most clearly in FIG. 4, preferably are in the general form of a triangle having a pair of angularly disposed downwardly and outwardly extending cam surfaces or edges 62 and 64. The remaining side or edge of the opening 52 may have any configuration since it is not necessary to the invention. Preferably the pivots 50 and the vertices of the opening 52 are formed with the same radius to facilitate pivotal action. The edge 62 is generally vertical when the bucket is at rest. In this manner the pivot 50 which may be seen in the preferred embodiment as having an oblong cross section with the elongated portion vertically aligned such that pivot 50 is seen to provide a pair of spaced, vertically disposed pivot points 66 and 67 at either end (the top and bottom) of the pivot 50. The longitudinal axis of the bucket which intersects the center of gravity or mass of the test tube and test tube carrier, is depicted by the line 68. The openings 52 which form the cam edges 62 and 64 are so positioned relative to this longitudinal axis 68 that the top pivot points 66; with the bucket in a rest position, are radially inside of the longitudinal axis. In this manner the weight of the buckets, the test tubes and their contents, being offset from the point 66 cause the bucket to hang with a slight negative angle. This facilitates locking the tubes with this slight negative for decanting.

In operation, as the rotor spins with the buckets unlocked, the buckets swing outwardly and upwardly and the lower end 67 of pivot 50 engages the left-hand edge or cam surface 62. As the bucket swings, the opening rotates counterclockwise such that the top 66 of the pivot 50 slides along the top cam 64, until the tube assumes a horizontal position. This latter position is depicted by the phantom lines 72 with upper end 66 of the pivot 50 contacting the cam edges 64 and the lower end 67 contacting the cam edge 62. The point of contact with cam edge 62 is the new pivot point with the bucket in a horizontal position. It will be noted that in accordance with this invention, the pivot point has shifted such as it is now at a point 70 above (normally toward the outside of the bucket) the longitudinal (now horizontal) axis 68' of the bucket such that the bucket can assume the horizontal position or orientation as previously described. This offset (the distance between the pivot point 70 and the horizontal axis 68') permits the bucket, whose centrifugal force vector acts along the axis 68', to assume a true horizontal orientation. The offset distance may be adjusted by properly configuring the opening 52 to accomodate different weight buckets and different spin rates. Essentially the product of the centrifugal force and the offset distance should equal the product of the weight of the bucket, its tube and contents and the distance from the pivot point 70 to the center of gravity or mass of the bucket, etc.

There are no particular dimensional of configurational requirements as to the pivot 50 except that its cross section be of sufficient length to cause the pivot point to shift from one side of the axis 68 to the other as the bucket swings out. It may be as thin as desired. Conversely the only configurational requirements on the holes 52 is that the top and left hand edges 64 and 62 respectively form downwardly opening, intersecting cam edges. The angle of intersection is approximately 60° in a preferred embodiment. It is preferred that the left hand edge be substantially vertically disposed when the bucket is vertical although this is not required. The degree by which the various edges are angled of course controls the degree of shift of the pivot point. The degree of shift of the pivot point is also controlled by the length L of the oblong pivot, in relation to the spacing of the cam edges 62 and 64 as noted. The hole 52 may assume any particular configuration and for that matter the cam edges 62 and 64 here illustrated as a straight line, which is a preferred embodiment, may assume a curved configuration. The distance $d_1$ from the normally perpendicular cam edge 62 to the longitudinal axis 68 should be less than the distance $d_2$ between the pivot points 66 – 67 i.e., the elongation of said pivot 50 should exceed the distance from the normally perpendicular cam edge 62 to the longitudinal axis 68.

The apparatus described is thus seen as a relatively simple means by which more positive operation of the swinging bucket type centrifuge may be achieved. The variable pivot point operation permits the buckets to hang at a slight negative angle which facilitates locking and negative angle decanting and at the same time permits the bucket to swing out to a true horizontal orientation.

I claim:

1. In a swinging bucket type rotor adapted to spin about a vertical axis with buckets disposed peripherally and pivotally about said rotor and adapted in use to pivot outwardly and upwardly, each said bucket having a longitudinal axis through its center of mass which axis is generally vertically oriented when said rotor is at rest, the combination comprising:

pivot means peripherally disposed on said rotor, each having a vertically elongated cross-section, for pivotally supporting each said bucket, a tab on each said bucket, said tab defining a pair of intersecting, downwardly opening, cam edges contacting said pivot means, the intersection of said cam edges lying on one side of said longitudinal axis, one of said cam edges extending to the other side of said longitudinal axis, such that the effective pivot point of said bucket shifts relative to said longitudinal axis as said bucket swings outwardly.

2. A rotor as set forth in claim 1 wherein the angle of intersection of said edges is acute.

3. A rotor as set forth in claim 1 wherein one of said cam edges is substantially parallel to said longitudinal axis.

4. A rotor as set forth in claim 3 wherein the angle of intersection of said edges is acute.

5. A rotor as set forth in claim 1 wherein the intersection of said cam edges is located on said bucket at a point radially of said rotor inside of said longitudinal axis when said bucket is vertically oriented.

6. A rotor as set forth in claim 5 wherein one of said cam edges is substantially parallel to said longitudinal axis and wherein said one edge is spaced from said longitudinal axis by a first distance, and said elongated cross-section exceeds said first distance.

7. A rotor as set forth in claim 1 wherein each said bucket has a pair of said tabs and said rotor has a pair of said pivot means.

* * * * *